US009010463B2

(12) United States Patent
Webb et al.

(10) Patent No.: US 9,010,463 B2
(45) Date of Patent: Apr. 21, 2015

(54) MULTI-AXIS MODULATION OF CUTTERS

(75) Inventors: Steven W. Webb, Woodlands, TX (US); Abhijit Suryavanshi, Columbus, OH (US)

(73) Assignee: Diamond Innovations, Inc., Worthington, OH (US)

( * ) Notice: Subject to any disclaimer, the term of this patent is extended or adjusted under 35 U.S.C. 154(b) by 28 days.

(21) Appl. No.: 13/551,812

(22) Filed: Jul. 18, 2012

(65) Prior Publication Data

US 2013/0020133 A1 Jan. 24, 2013

Related U.S. Application Data

(60) Provisional application No. 61/509,255, filed on Jul. 19, 2011.

(51) Int. Cl.
*E21B 7/24* (2006.01)
*E21B 10/567* (2006.01)

(52) U.S. Cl.
CPC ..... *E21B 7/24* (2013.01); *E21B 10/567* (2013.01)

(58) Field of Classification Search
CPC ..... E21B 10/62
USPC ..... 175/343, 352, 354, 379, 381, 383, 384, 175/319, 263
See application file for complete search history.

(56) References Cited

U.S. PATENT DOCUMENTS

| | | | | |
|---|---|---|---|---|
| 4,553,615 | A * | 11/1985 | Grainger | 175/432 |
| 6,925,915 | B1 | 8/2005 | Claesson | |
| 7,703,559 | B2 | 4/2010 | Shen | |
| 2006/0251480 | A1 | 11/2006 | Mann | |
| 2007/0069611 | A1 * | 3/2007 | Lee | 310/328 |
| 2011/0088955 | A1 * | 4/2011 | Cooley et al. | 175/428 |

* cited by examiner

*Primary Examiner* — Cathleen Hutchins
*Assistant Examiner* — Ronald Runyan

(57) ABSTRACT

A method of prolonging the life of a PDC cutter having a substantially cylindrical shape centered about a rotational axis, and an apparatus for multi-axis modulation of a PDC cutter, the method including imparting linear modulation to the cutter in at least one direction and imparting rotary modulation to the cutter about the rotational axis, the rotary modulation being synchronized with, and facilitated by, the linear modulation.

24 Claims, 12 Drawing Sheets

Conventional cutting (A1)

4.5 $in^3$ 9.0 $in^3$

Modulation assisted cutting (B1)

31.2 $in^3$ 35.6 $in^3$ 40.1 $in^3$

1947-PASS-18-D-1-25
Merc1608SB-18 pass

1984-PASS-38-D-1-25
Merc1613-38 interrupted passes

MULTI-AXIS MODULATION OF CUTTERS

CROSS-REFERENCE TO RELATED APPLICATIONS

This application is based on and claims the priority benefit of previously filed U.S. Provisional Patent Application No. 61/509,255, filed Jul. 19, 2011.

TECHNICAL FIELD AND INDUSTRIAL APPLICABILITY

The present disclosure relates to methods and apparatus for reducing the wear and heat exposure of polycrystalline diamond compact (PDC) cutters during cutting, drilling, and mining applications.

A polycrystalline diamond compact cutter is typically formed in a substantially circular or cylindrical shape about an axis, and has 360 degrees of usable hard edge or working edge. These cutters are used in various cutting, drilling, and mining operations for cutting or drilling a target surface of hard rock. For example, for drilling rock, a plurality of PDC cutters are typically attached to drag bits by torch brazing at high heat (greater than 700° C.).

When a PDC cutter is fixed to the bit and the cutter is exposed to a target surface of hard rock at a rake angle with respect to the axis of the cutter, only a segment of the cutter edge is used. Therefore, to make use of the entire working edge of the cutter, the cutter must be periodically detached from the bit, rotated, and reattached to expose a different segment of the edge to the target surface. However, pulling the worn bit out of the hole, inspecting, detaching, rotating, and reattaching cutters is very time consuming, especially since the worn bit can be up to 7 km deep in the earth and often contain up to 50 cutters, each brazed at high heat.

As a result, sometimes a cutter edge is allowed to wear significantly before rotating the cutters, and with increased wear comes increased frictional heat. Excessive heat can damage PDC, and allowing a cutter to wear too much on one segment of the edge can distort the cutter. Due to this distortion, only two, or at most three, reattachments are possible before the cutter is worn out completely and is impossible to fix to the bit by brazing. In some cases, the heat and resulting distortion is so great that the cutter must be scrapped with only one segment used.

During conventional cutting, as shown in FIG. 1, the PDC cutter is forced into contact with a hard rock target surface, as well as rock debris that results from cutting, such that coolant or lubricant fluid cannot get between the working edge and target surface. Thus, the working edge is subjected to significant dry friction without the benefit of lubrication. Coolant is used, and may be helpful, but even at very high supply pressures coolant cannot penetrate between the working edge of the cutter and the target surface due to hard contact surfaces and high pressure. Consequently, to reduce frictional heat in the cutter, little can be done other than to reduce the penetration rate (e.g., drill RPM and advance rate) and/or increase coolant flow to try to cool the bit via conduction from the working edge to a portion of the bit reached to the coolant.

In a drilling operation, when the working edges of the PDC cutters are dulled to a user-defined limit, an entire drill pipe and bit must be pulled out of the hole so that the working edges can be refreshed. The blunted bit is detached, the cutters are debrazed and evaluated for wear, and if wear is not too bad the cutters rotated to expose a fresh edge segment and rebrazed. As noted above, this operation can be performed up to three times, after which the cumulative thermal and physical damage to the edge typically renders the cutter unusable. Sometimes, if the working edge is allowed to wear too much before removal of the bit, the cutter may need to be scrapped after using only one segment of the edge. Therefore, it would be preferable to provide a mechanism for spreading wear more evenly across and around the working edge without needing to take the bit out to debraze, rotated, and reattach the cutters, as well as to enable lubrication of the working edge.

Linear modulation of a cutter includes oscillating linear motion of a cutter in a direction defined by a coordinate system which periodically changes the relationship between a cutting edge of the cutter and a target surface on a workpiece. As a result, linear modulation periodically alters the contact force between cutting edge and workpiece. Various parameters of linear modulation can be adjusted, including the frequency and amplitude of modulation, as well as the coordinate system along which motion occurs.

Linear modulation of a cutter, without rotation of the cutter, has been used in other industries, but not in rock drilling. For example, linear modulation has been used to change chip morphology in metal cutting, to mitigate thermal and thermochemical tool wear, and to affect surface roughness. But linear modulation alone does not address the problem of lack of uniform circumferential wear on the working edge of PDC cutters, since it involves no rotation of the edge.

Rotating cutters have been attempted by the use of bearings that allow 360 degrees of rotation of a cutter with respect to the bit, theoretically enabling the working edge of a cutter to be used evenly. Cutters, jammed into rock under high weight-of-bit or pressure require very high force to cause rotation. This is particularly true for cutters that may have irregular edge geometries, such as chips and wear flats. This force can be taken from the rotational torque on the bit by designing the rake and attack angles of the cutter into the hard rock such that a large shear force is applied to the edge of the cutter. Nonetheless, virtually any wear flat that develops on the edge, at any time during drilling, increases the force required to rotate the cutters exponentially, such that the cutters stop rotating. Further, these bearing-based rotating cutters tend to seize up under the high forces and abrasion that result from drilling. In particular, bearings, even if made from the hardest steel, do not work long when hard grit gets between the bearing elements and the race, particularly when the bearings are subjected to very high forces such as forces exceeding 5 kN commonly encountered by drag bits. Methods to seal and/or flush the bearing have proven feasible with larger bearings of tricone bits, but are not practical for smaller cutters. Therefore, cutter rotation is mechanically difficult to accomplish without an independent source of rotational power and a way to reduce force on the cutter edge during rotation.

SUMMARY

An embodiment of a method is disclosed for prolonging the life of a PDC cutter having a substantially cylindrical shape centered about a rotational axis. The method includes imparting linear modulation to the cutter in at least one direction and imparting rotary modulation to the cutter about the rotational axis of the cutter. The cutter rotary modulation is synchronized with, and facilitated by, the linear modulation. While either linear or rotary modulated motion by itself may produce advantageous edge life results, their use together amplifies the benefit. In one variation, the method further includes lubricating a cutting surface of the cutter with a fluid film that flows between the cutter and the target surface when the cutter is disengaged from the target surface due to one or both of the linear and rotary modulation.

An embodiment of an apparatus is disclosed for multi-axis modulation of a PDC cutter. The apparatus includes means for modulating the PDC cutter in a direction tangential to a target surface, normal to the target surface, or a combination thereof, and means for enabling free rotational modulation of the PDC cutter about a rotational axis when the cutter is at least partially disengaged from the target surface. In one variation, the cutter is rotated by a rotational actuator such as a stepper motor. In another variation, the cutter is rotated and modulated by hydraulic force.

Another method is disclosed for prolonging the life of a PDC cutter having a substantially cylindrical shape centered about a rotational axis. The method includes imparting linear modulation to the cutter in at least one direction, and lubricating a cutting surface of the cutter with a fluid film that flows between the cutter and the target surface when the cutter is at least partially disengaged from the target surface due to the linear modulation.

BRIEF DESCRIPTION OF THE DRAWINGS

The foregoing summary, as well as the following detailed description of the embodiments, will be better understood when read in conjunction with the appended drawings. For the purpose of illustration, there are shown in the drawings some embodiments which may be preferable. It should be understood, however, that the embodiments depicted are not limited to the precise arrangements and instrumentalities shown.

As shown in FIG. 2A, when the cutter is linearly modulated away from the target surface, lubricant penetrates between the cutter and the target surface. During this motion, the contact force decreases, potentially to zero, thus allowing low-torque rotary motion of the cutting tool. The tool is not in continuous rotary motion; it moves only when contact force decreases below an amount corresponding to an applied torque. As shown in FIG. 2B, when the cutter is linearly modulated into contact with the target surface, a film of lubricant remains that lubricates and cools the working edge of the cutter;

DETAILED DESCRIPTION

Figure 1:
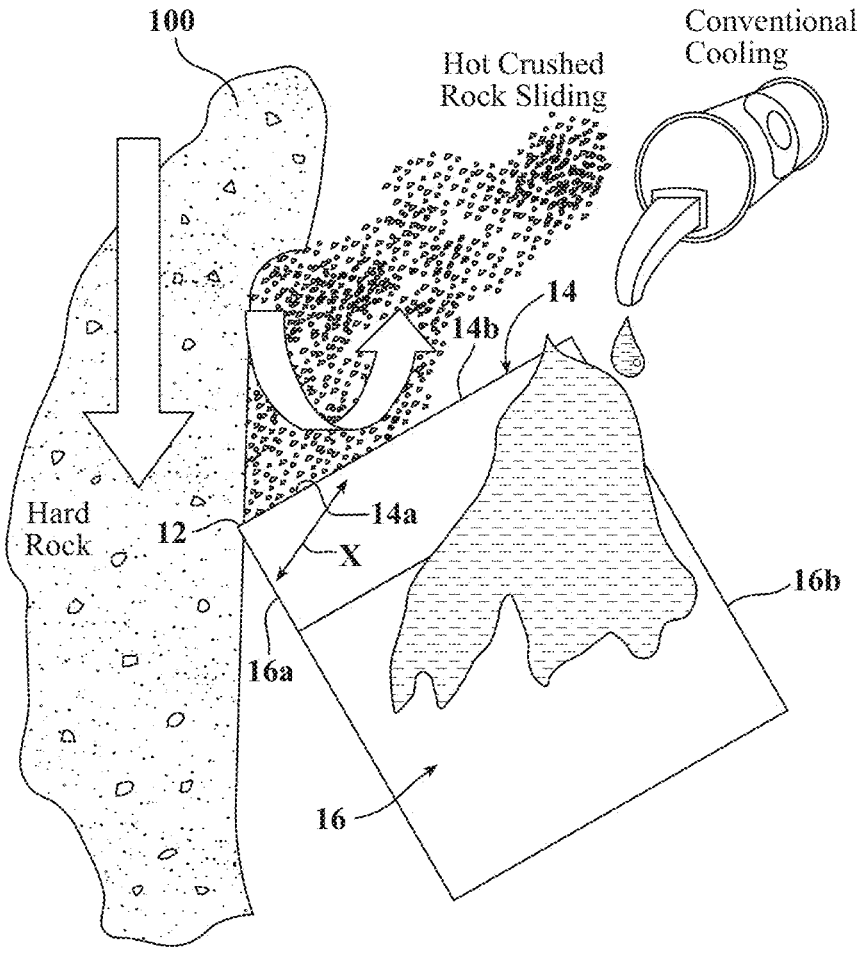
FIG. 1 (Prior Art)
FIG. 1 is a schematic illustrating a prior art method of advancing a cutter against a target surface in which a working edge of the cutter is continuously and non-rotatably engaged with the target surface under high contact force and pressure, neither coolant nor lubrication can penetrate between the cutter and the target surface.

FIG. 1 shows conventional drilling using a circular or cylindrical tool bit having a PDC cutter 10 (inclined cylinder with PDC layer on top of carbide substrate). The cutter 10 may include a top or rake surface 14 and a side or flank surface 16 joined at a working edge 12. In use, the rake surface 14 has a first portion 14*a* that is adjacent to the working edge 12 and in contact with rock debris and a second portion 14*b* that is generally not in contact with rock debris, with the portions 14*a* and 14*b* changing with cutter rotation. Similarly, in use, the flank surface 16 has a first portion 16*a* that is adjacent to the working edge 12 and in contact with rock debris and a second portion 16*b* that is generally not in contact with rock debris. As shown in FIG. 1, the cutter 10 is engaging a hard rock target surface 100 at the working edge 12 of the cutter 10. The cutter 10 may crack the hard rock target surface 100, and sweep away rock debris on the first portion 14*a* of the rake surface 14 of the cutter 10. Most of the frictional heat of the cutting operation may be generated on the rake surface first portion 14*a* of the cutter 10 as crushed rock accelerates and abrades the rake surface 14. Liquid coolant applied to the cutter primarily reaches only the second portion 14*b* of the rake surface 14 and the second portion 16*b* of the flank sides 16 of the cutter 10, and cannot get close to the working edge 12 or the first portions 14*a*, 16*a* of the rake and flank surfaces 14, 16, respectively. Even when pressurized to 2500 PSI, fluid lubricant cannot get between the crushed rock debris and rake and flan surface first portions 14*a*, 16*a*.

When sliding crushed rock heats the cutter rake surface 14, the heat ablates, chips, and/or delaminates the rake surface 14 and/or conducts to the working edge 12 which is cutting the hard rock. Heat softens polycrystalline diamond (PCD), increasing abrasive wear at the working edge 12 and increasing the contact area of the working edge 12. As the contact area increases with wear, forces and friction increases exponentially, resulting in more heat. The increase in force may increase bending tension in the cutter that could potentially fracture the edge. Unlike carbide or ceramic, PCD exponentially softens with temperature due to phase metastability. In extreme heat (e.g., with no coolant flow) diamond reverts to micro-cracked diamond grains and black carbon with low thermal conductivity and near-zero wear resistance. Heat and cracks accumulate at the working surface 12 and wear accelerates autocatalytically. Eventually the working edge 12 may be undermined by thermal cracking of the rake surface 14, causing the edge to fracture. In some cases, the working surface 12 contact area becomes too large to sustain cutting at the limiting torque on the bit or the diameter of the hole being drilled gets too small.

Figure 2A:
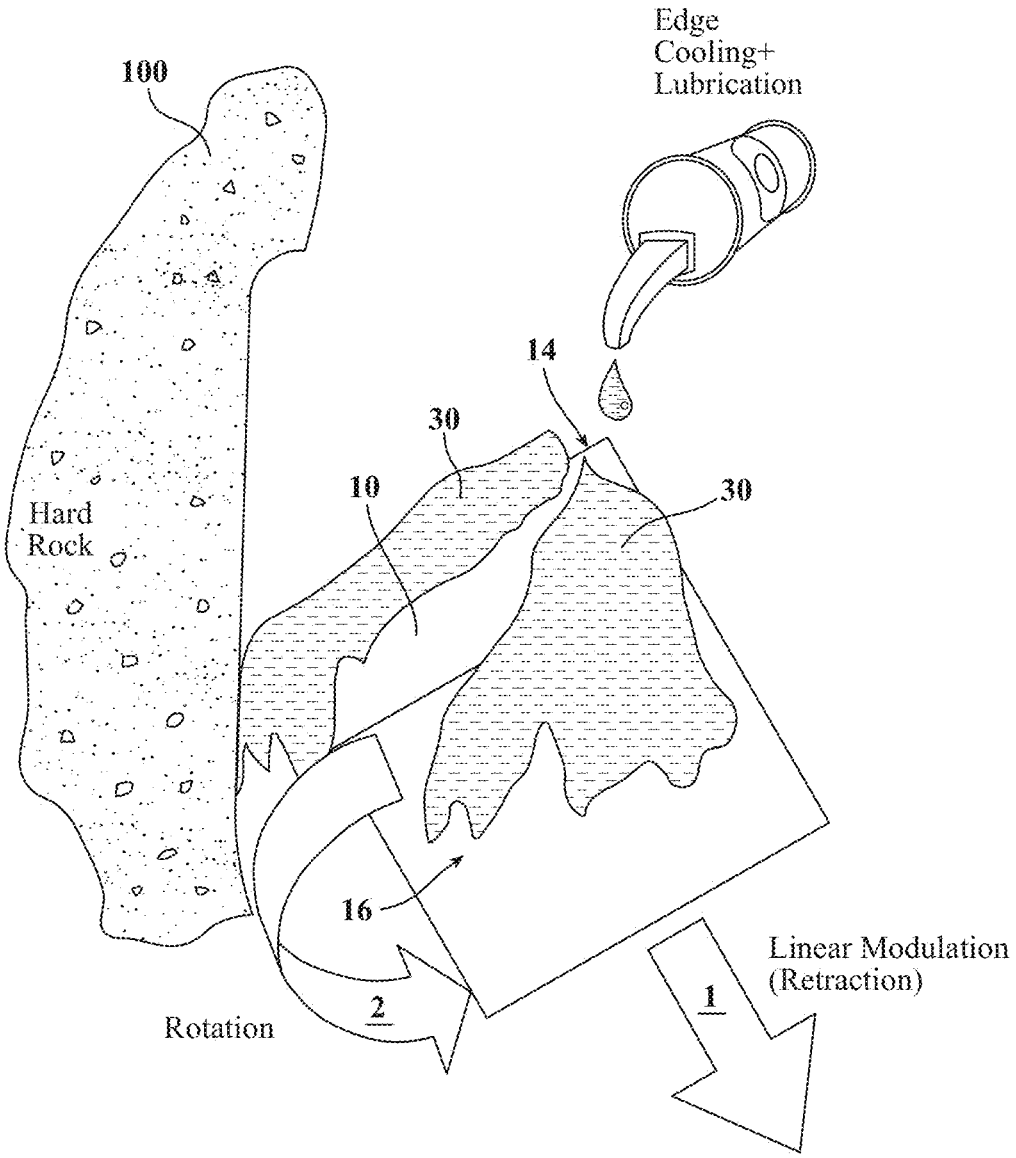
FIGS. 2A and 2B are schematics illustrating a method of advancing a cutter against a target surface in which the cutter is subjected to synchronized linear and rotary modulated motion.
Figure 2B:
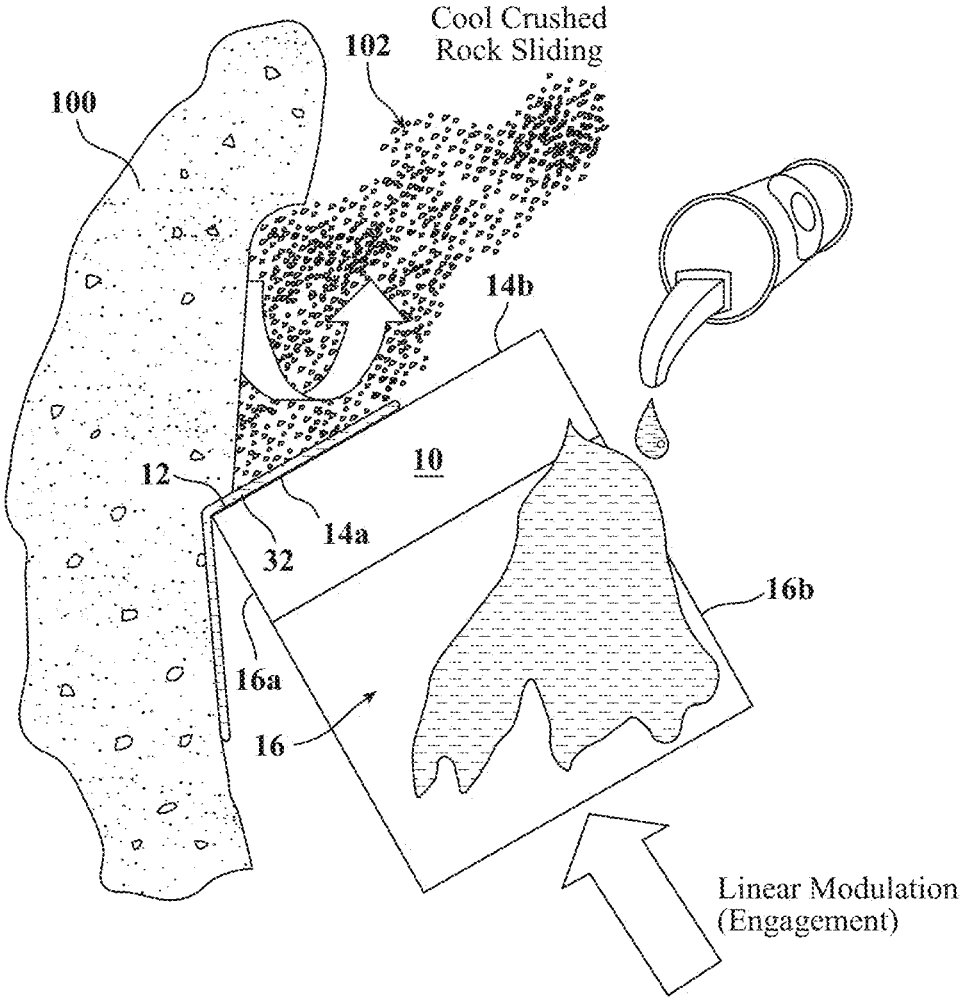

FIGS. 2A and 2B show the use of a PDC cutter 10 having a substantially cylindrical shape centered about a rotational axis. To remedy problems with existing cutters, both linear modulation (1) and rotation or rotary modulation (2) are imparted to the cutter 10 during use. The rotary modulation is synchronized with the linear modulation. In particular, as shown in FIGS. 2A and 2B, the rotary modulation is imparted while the cutter 10 is disengaged from the target surface 100 of rock, so that less torque is required to impart the rotary modulation.

Linear modulation periodically alters the contact force between cutting edge and workpiece. Linear modulation, as used herein, does not include the type of modulation that occurs in impact or hammer drills, in which a drill bit is repeatedly driven with high levels of force into a target surface, resulting in sharp impacts that can fracture rock and hasten drilling. Rather, with appropriate amplitude, linear modulation periodically eliminates contact, creating a transient non-zero physical gap between the cutter 10 and the rock target surface 100 for at least a very short period of time, so that the contact force periodically goes to zero or very near zero. Therefore, by creating this transient gap, linear modulation can be effective to enable periodic lubrication and cooling of non-rotating tools. In the depicted embodiment, linear modulation includes periodically disengaging or retracting the working edge 12 of the cutter 10 from the target surface 100 and the reengaging the working edge 12 of the cutter 10 with the target surface 100.

Figure 3:
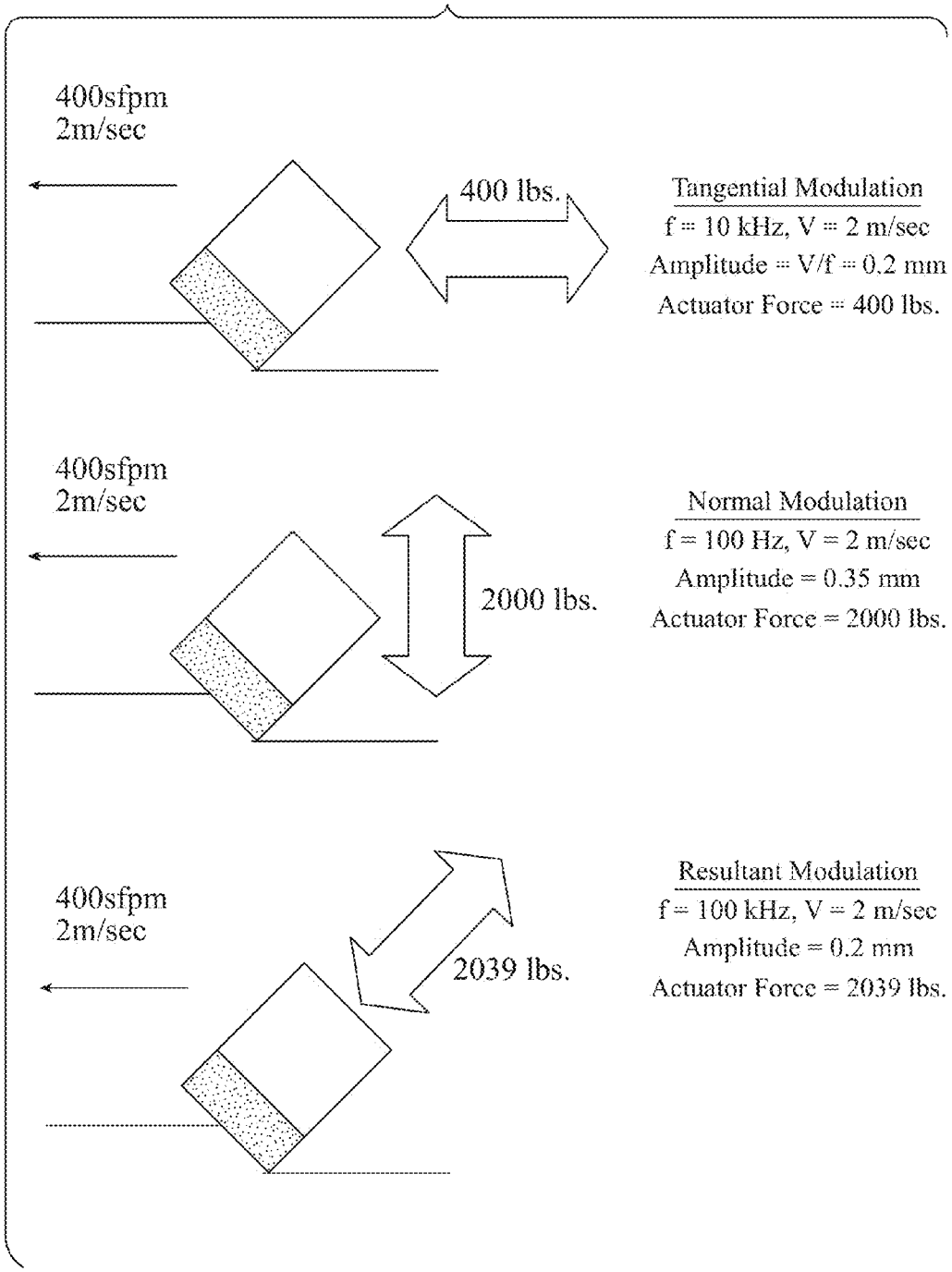
FIG. 3 is a set of schematics illustrating geometric variations of linear modulation, including tangential modulation, normal modulation, and resultant modulation.

Linear modulation is performed in at least one direction, or can be performed in a combination of directions, as shown in FIG. 3. For example, tangential modulation causes the cutter to oscillate back and forth in a plane parallel to the target surface and the direction of cutting, while normal modulation cause the cutter to oscillate back and forth in a plane perpendicular to the target surface and the direction of cutting. Normal modulation requires high forces of at least 10 kN but can be done at low frequencies, while tangential modulation (with or without rotation) requires lower forces of less than 3 kN but must be done at higher frequencies. When both tangential and normal modulations are applied simultaneously, a resultant modulation occurs at an angle between parallel and perpendicular. The geometry used in practice may depend on the available actuation system and physical size limitations of the bit.

Modulation frequency (cycles per second) depends on how fast the cutting edge heats up while cutting rock (partially dependent on the thermal conductivity of the PCD) and how much temperature softens the flank 16 of the cutter 10. PCD with high residual metal content, from smaller grain size diamond, may require lower modulation frequency.

The amplitude and waveform (e.g., sine wave, square wave) of modulation depends on cutting conditions of depth-of-cut and bit revolutions per minute (RPM). Sufficient amplitude is required to break contact (i.e., to reduce the contact force to zero or near-zero) and create a gap sufficient to allow fluid penetration onto the working edge 12 and the first portions 14*a*, 16*a*, of the rake and flank surfaces 14, 16, respectively. In an exemplary embodiment, the gap is large enough to enable complete fluid penetration of these surfaces. The periodic gap may depend on rock roughness as-cut, adhesion of rock to the PCD, fluid viscosity and pressure. When pressure is higher, fluid (coolant, lubricant) viscosity may be lower, and the rock is smoother (depends on grain size and compressive fracture strength of the rock), a smaller gap need be provided to make the modulation effective at enabling lubrication.

Rotary motion (degrees) per unit modulation cycle depends on the torque available, the resistance of bearing surfaces supporting the cutter, and the time period during which applied torque exceeds the contact force between the cutter 10 and the target surface 100.

When imparting linear modulation in the tangential direction, a modulation frequency of at least about 1 Hz may be used to prevent PCD overheating. In the normal direction, modulation may be conducted at frequencies as low as 10 Hz. At a cutting speed of about 400 SFPM (surface feet per minute), or about 2 m/sec across the target surface, with a normal force of about 2000 lbs. (about 10 kN), the amplitude of modulation for tangential modulation may be at least about 0.02 mm, and preferably at least about 0.2 mm, for example. For normal modulation, the amplitude may be at least about 0.35 mm, and as large as 0.5 mm, for example. This amplitude of linear modulation may be able to sufficiently disengage the cutter from the target surface so that pressurized lubricant may flow into a gap between the working edge 12 and first portion 14*a* of the rake surface 14 of the cutter 10 and the target surface 100.

For normal modulation, an actuator for these conditions may require a minimum power of 200 W (the product of 10 kN, 0.0002 meters, and 100 Hz), for example. Additionally, to maintain the required cutting force, the stiffness of the actuator may be at least about 5 N/μm (10 kN over 0.2 mm distance), for example. For tangential modulation, empirical data indicates that a modulation force of about 400 lbs (about 2 kN), for example, may suffice.

Linear modulation has been demonstrated in single point iron and steel machining. By periodically modulating the cutter—disengaging the working edge from workpiece, lubricating the edge with fluid, then plunging the edge back into contact with the target surface—at frequencies ranging from about 1 Hz to about 1 kHz, for example, and at amplitudes scaled with the chip size (e.g., based on infeed rate and depth-of-cut), the working edge is not allowed to overheat. Thus, the edge does not thermally soften or suffer thermal delamination and chipping. Additionally, modulation may enable a renewable perpetual film of lubricant to be provided to the working edge, allowing higher cutting speeds with nominal edge life and reliable drilling with less chipping.

In practice, an actuator for performing linear modulation may be embedded in the drag bit on which the cutter is mounted. Since any actuator performing linear modulation must support the cutting force, a high-stiffness actuator may be required. An actuator for this purpose may be a piezoelectric actuator, an actuator including one or more piezoelectric elements, or a piezomotor. In another exemplary embodiment, a hydraulic fluid may be modulated by a piezomotor, perhaps combined with a spring, to provide high-force linear modulation, similar to systems used in diesel-engine fuel injectors. In another exemplary embodiment, a simple reciprocating piston pump may be used to apply push and pull linear modulation. Alternatively, electrical, magnetic, or other actuators known in the art may be used.

Rotary motion may be provided by a hydraulic pump pressure (mud pressure). When linear actuator withdraws the cutter, applied hydraulic pressure or torque may cause the cutter to rotate, until the cutter is re-engaged, thereby producing modulated cutter rotation. In some exemplary embodiment, rotation may occur in only one direction, for example.

In one exemplary embodiment in which linear modulation is imparted in the tangential direction, a modulation frequency of about at least about 1 Hz, for example, may be used. In another embodiment, a modulation frequency of less than or equal to about 10 kHz, for example may be used. The amplitude of linear modulation in the tangential direction may be at least about 0.01 mm for every 1 m/s, for example, in cutting speed, and sometimes, at least about 0.1 mm for every 1 m/s in cutting speed. For example, at a typically cutting speed of about 2 m/s (400 SFPM), the modulation amplitude may be at least about 0.2 mm.

In one embodiment in which linear modulation is imparted in the normal direction, a modulation frequency of at least about 10 Hz may be used. In another embodiment, a modulation frequency of about 100 Hz may be used. The amplitude of linear modulation in the normal direction may be at least about 0.2 mm to allow a sufficient gap for lubricant to flow. When normal and tangential modulations are used in combination, the amplitude of the resultant modulation may be at least about 0.35 mm, for example.

Thermal modeling based solely on cooling shows that cutter edge temperature may be reduced 300° C. by linear modulation, not including any temperature reduction effects due to lubrication or modulated rotation enabled by the linear modulation.

Linear modulation may be augmented with synchronized rotary modulation of the cutter. In some exemplary embodiment, the rotary modulation may be separately powered. In one embodiment, the cutter rotates continually without the need for rock contact so that a wear flat has no chance of being formed due, for example, to loss of bit RPM, or decreased RPM, during cutting. This requires an independent source of motive power to the cutters. The cutter rotation may be synchronized with linear modulation, and both rotation and linear modulation may be independent of bit rotation and drill motion.

In another embodiment, the cutter rotates when it is disengaged from the hard rock target surface. Applying linear modulation, to periodically eliminate or reduce the contact force, may make cutter rotation much simpler to accomplish. The cutter need not be forced to rotate while being jammed in to rock. Rotation in the absence of loading on the cutter may require low torque. This method of rotation may also require low-load bearings which are easier to keep clean. Finally, modulation in both linear and circumferential directions allows more improved access of cooling and lubricant fluid to the cutting edge compared to modulation in either direction singularly. Disengaging the cutters periodically from the rock requires an independent source of power be applied to the cutters to cause rotation. Linear modulation may also require an independent source of power be applied to the cutters.

A bearing is provided to enable rotation about the axis of the cutter. Linear modulation facilitates rotation of the cutter by periodically disengaging the cutter and removing drilling forces from the cutter. As a result, only a small motor may be needed to accomplish step rotation of the substantially unloaded cutter. Thus, combining synchronized rotary modulation with linear modulation may overcome the problem of bearings attached to cutters that are unable to rotate when highly loaded and thus more susceptible to erosive wear. Indeed, linear modulation may facilitate modulated cutter rotation with only fluid film lubrication, without any bearing at all. By superimposing periodic or continuous rotation on linear modulation, a worn working edge segment may be moved to expose a fresh working edge segment. This allows uniform use of 360 degrees of the working edge during drilling without detaching the cutter or removing the bit. Rotation is may be done during edge retraction, when the cutter is substantially unloaded.

In one embodiment, external rotation mechanism may not be provided, because when the cutter is disengaged from the target surface, the bearing is substantially unloaded, which allows the cutter to freely rotate when buffeted by rock debris contacting the rake and flank surfaces of the cutter. Thus, the linear modulation by periodically disengaging the cutter from the target surface creates a condition in which rotation of the cutter may easily occur. Because rotation of the cutter is vastly more difficult when the bearing is loaded due to contact between the cutter and the target surface, the rotary modulation becomes effectively synchronized with the linear modulation; the cutter rotates when the cutter bit is disengaged from the target surface and remains substantially non-rotating when the cutter is engaged with the target surface. This occurs at a rate of about 1 Hz to about 10 kHz, for example. Although such rotations will be random, over time and hundreds or thousands of step rotations, the working edge of the cutter will be uniformly exposed to the target surface.

In another embodiment, the rotary modulation may be imparted by a torque system including a rotational actuator, for example. The rotational actuator may be a motor such as a small magnet stepper motor. Alternatively, the rotational actuator may be hydraulically powered, either dynamically (e.g., from a piston pump) or statically (e.g., from a centrifugal pump). The rotational modulation may be imparted at an amplitude so that eventually every segment of the working edge is exposed to the target surface.

In another embodiment, rotary motion is not used at all. The edge is modulated only linearly. This motion will facilitate edge lubrication, thus preventing edge overheating and thermal softening, but may, of course, concentrate wear on one arc of the cutter circumference. This approach eliminates the need for bearings or specific cutter designs that enable rotational motion.

To reduce heat in the cutter, and to thereby increase the life of the cutter, a cutting surface of the cutter 10 may be lubricated with a film of lubricant and/or coolant. The cutting surface of the cutter 10 may include the first portion 14*a* of the rake surface 14 and the working edge 12, as well as the second portion 14*b* of the rake surface 14 and the flank surface 16. As a result of the linear modulation, the lubricant and/or coolant 30 may be able to lubricate the cutting surface of the cutter 10 by forming a fluid film 32 that flows between the cutter 10 and the target surface 100 when the cutter 10 is disengaged from the target surface 100 due to the linear modulation. This fluid film 32, or a solid lubricant that is residual from the fluid film 32, may remain at least partially in place when the cutter 10 is brought back into engagement with the target surface 100, to reduce friction and heat at the working edge 12 of the cutter 10, as well as along the rake surface 14 and the flank surface 16.

By removing the cutter 10 from contact with hard and crushed rock periodically by linear modulation or oscillation, fluid 30 may flow to the exposed flank surface 16 and rake surface 14 of the cutter 10, cooling and/or lubricating those surfaces. The cutter 10 that has been lubricated by the fluid film 32 may be driven back into hard rock by linear modulation. The lubricant film 32 allows crushed rock 102 to slide freely over the rake surface 14 with low friction, and also may allow hard rock 100 to slide over flank surface 16.

The lubricant may be formulated as a solid or fluid film capable of supporting high contact pressure between the cutter 10 and the target surface 100, which in some cases may exceed 1 GPa (e.g., 5 KN over 5 $mm^2$), for example. The lubricant may include fluid oils, emulsions, solid or EP ("extreme pressure") lubricants (e.g., $MoS_2$, talc, steatite, mica, biotite). The lubricants may be pre-milled into the mud fluid or dropped as rock to the bottom of the hole and ground up by the drill. When the linear/rotary modulation exposes the cutter edge, it is coated with fluid, coolant and lubricant grains, and then jammed back into contact with hard rock.

In sum, linear modulation combined with synchronized rotation may allow for perpetual lubrication film coating and substantially uniform circumferential wear. Combining the two motions may eliminate thermal softening, thermal delamination, and chipping, and utilizes the entire working edge of a substantially circular or cylindrical cutter in one drill setup (i.e., without removal and rebrazing). This enhances cutter life and productivity as compared with a conventional fixed cutter that must be removed, rotated, and rebrazed, and may be overheated by continual contact with hard rock.

Figure 4:
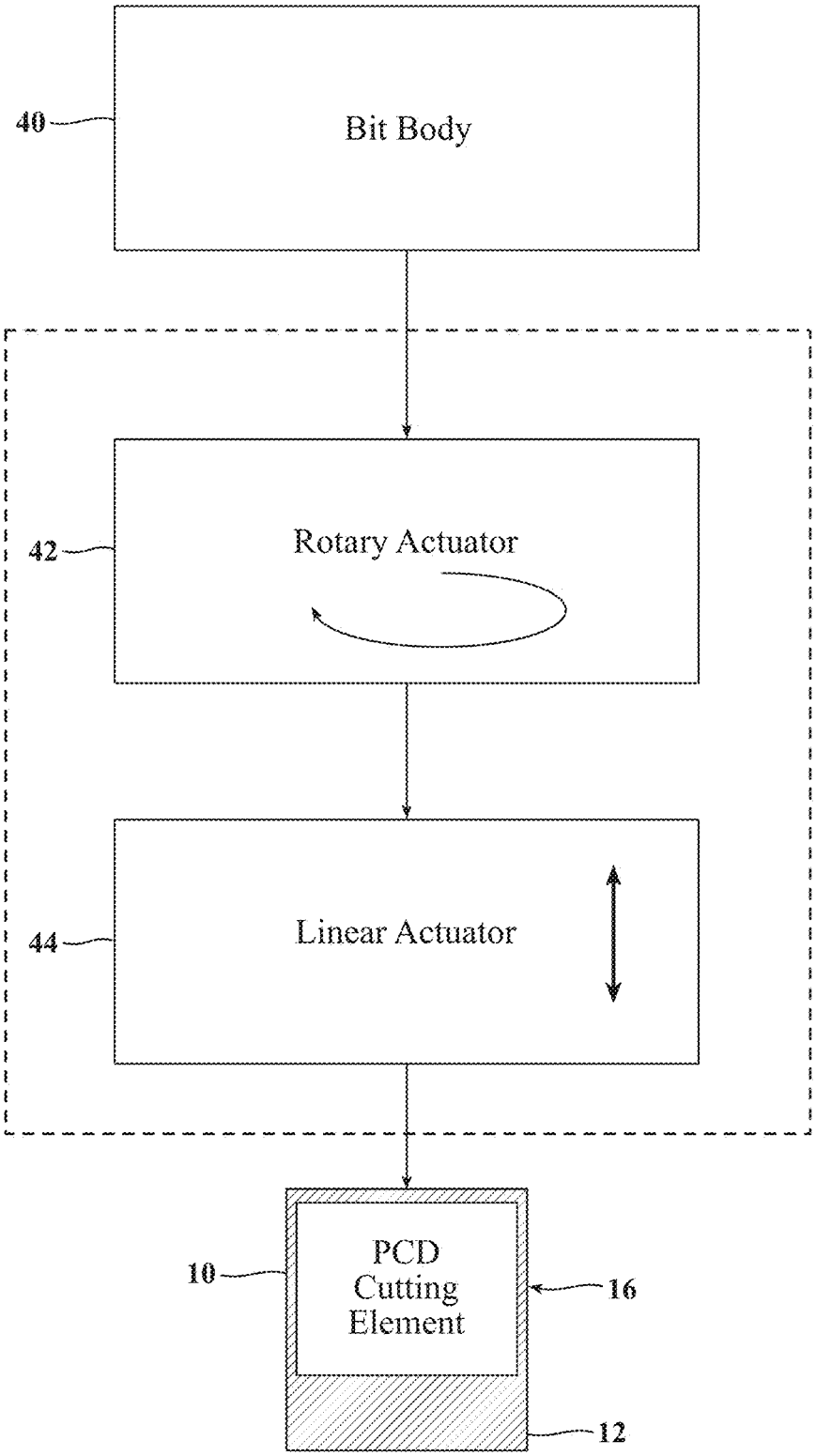
FIG. 4 is a schematic view of PCD cutting element with a rotary actuator and linear actuator in use according to an exemplary embodiment.

As shown in FIG. 4, an apparatus to accomplish synchronized linear and rotary modulation of a PDC cutter may include means for modulating the PDC cutter, such as a linear actuator 44, embedded in the bit body 40 on which the PDC cutter 10 is mounted and a means for enabling free rotational modulation, such as a rotational bearing located between the PDC cutter 10 and the bit body 40. The linear actuator may include a piezoelectric actuator, and may modulate the cutter in a direction tangential to a target surface, normal to the target surface, or a combination thereof. The rotational bearing may allow free rotation of the cutter about a rotational axis when the cutter is disengaged from the target surface but is essentially locked against rotation when the cutter is engaged and the bearing is highly loaded.

The apparatus may also include a rotational actuator for modulating the cutter about the rotational axis. In operation, the rotational actuator may be synchronized with the linear actuator so that the cutter is rotated only when the cutter is disengaged from the target surface.

Still in FIG. 4, the PDC cutter 10 may be modulated in a linear direction by the linear actuator 44. The cutter-linear actuator assembly may be driven by the rotary actuator 42. The cutter 10, linear actuator 44, rotary actuator 42 may be placed in specific locations inside a bit body, for example, pockets on the shoulder of the bit body 40. The sequence of the actuators may be changed, for example, the rotary actuator 42 may rotate the cutter 10, while the linear actuator 44 may drive the cutter-rotary actuator assembly. Alternatively, both the rotary movement and the linear movement can be contained inside a single actuator.

Figure 5:
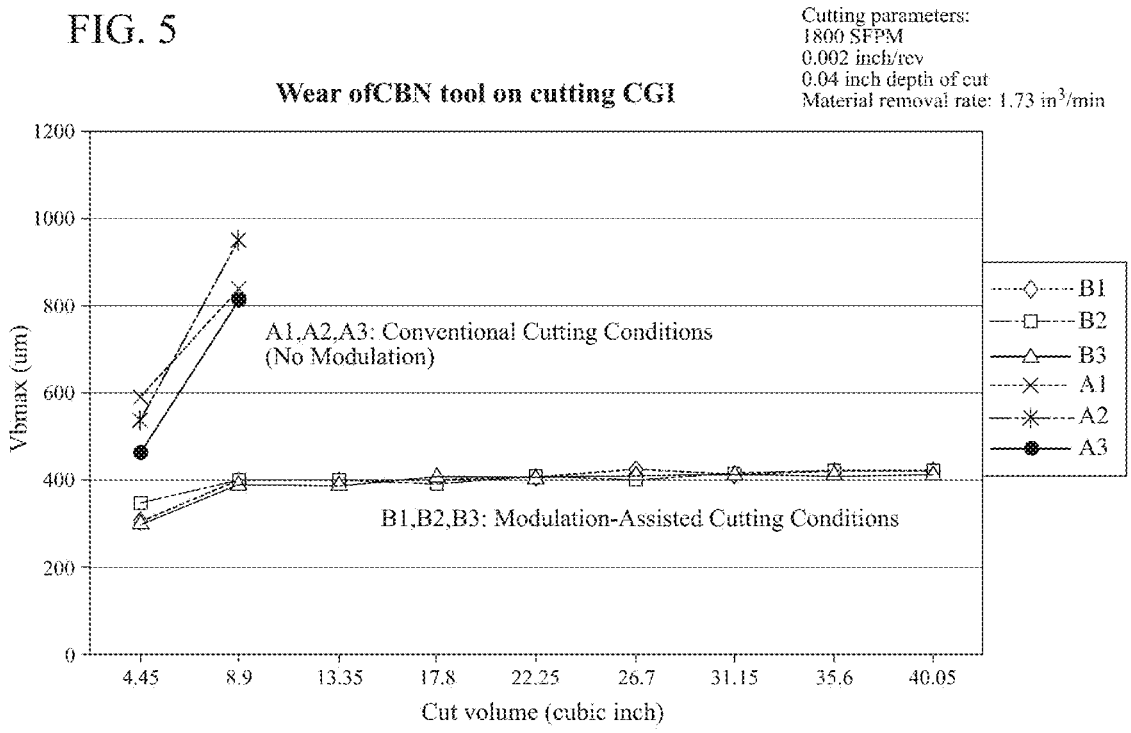
FIG. 5 is a graph comparing cutting tool wear under non-modulated and modulation-assisted cutting conditions.

FIG. 5 shows the results of tests that were conducted using conventional facing cutting (no modulation of the cutter) and modulation-assisted facing (linear modulation of the cutter). Unlike drilling, a facing cut may use three-dimensional motion, tangential (rotation, RPM or feet per minute when provided with the workpiece diameter), depth of cut (inches, into the workpiece) and traverse (inches per revolution, across the workpiece). The product of these three conditions is the cutting rate in cubic inches per minute.

In the illustrated case, modulation was traverse. There is no cutter rotation; the edge is a single point and not a round. Vbmax is a measurement of the maximum wear dimension along the flank, in micrometers. Tests were conducted at a cut rate of 1800 SFPM, with a 0.04 inch cut depth at 0.002 inches per revolution, and a material removal rate of 1.73 cubic inches per minute.

Figure 6:
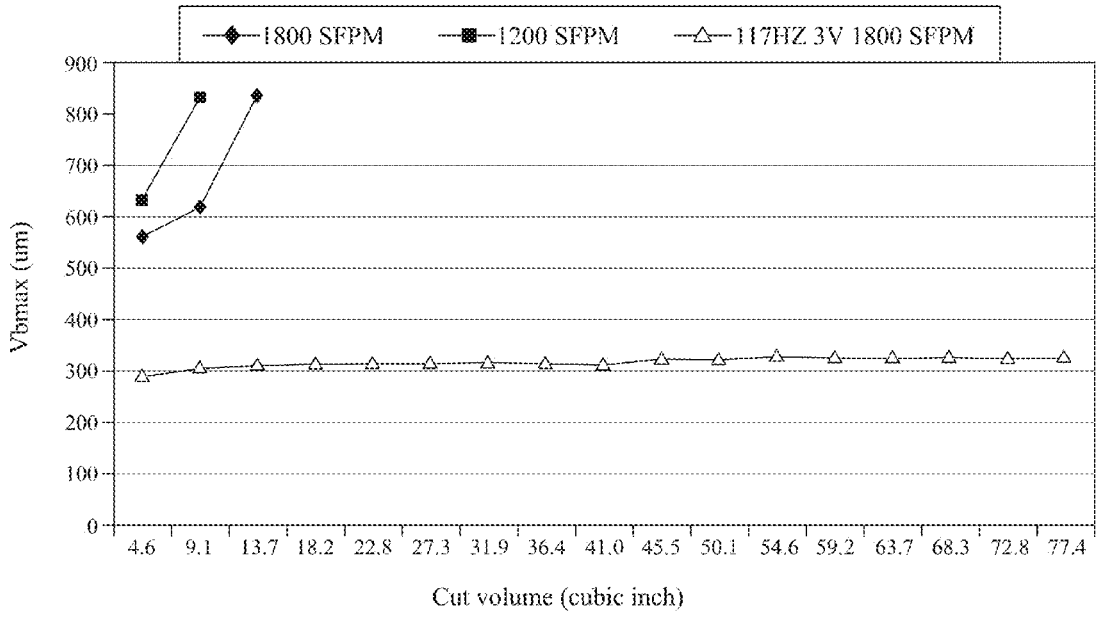
FIG. 6 is a graph comparing cutting tool wear under non-modulated and modulation-assisted cutting conditions.

As shown, cutters used under modulation-assisted cutting conditions experienced about 30% to about 55% less wear than cutters used under non-modulated cutting conditions, for the same total cut volumes. In addition, the wear on the modulation-assisted cutters was sufficiently small that much larger cut volumes could be achieved with significantly less wear on the working edge of the cutter. The data in FIG. 6 shows a similar result using linear modulation of 117 Hz, for example.

Figure 7:
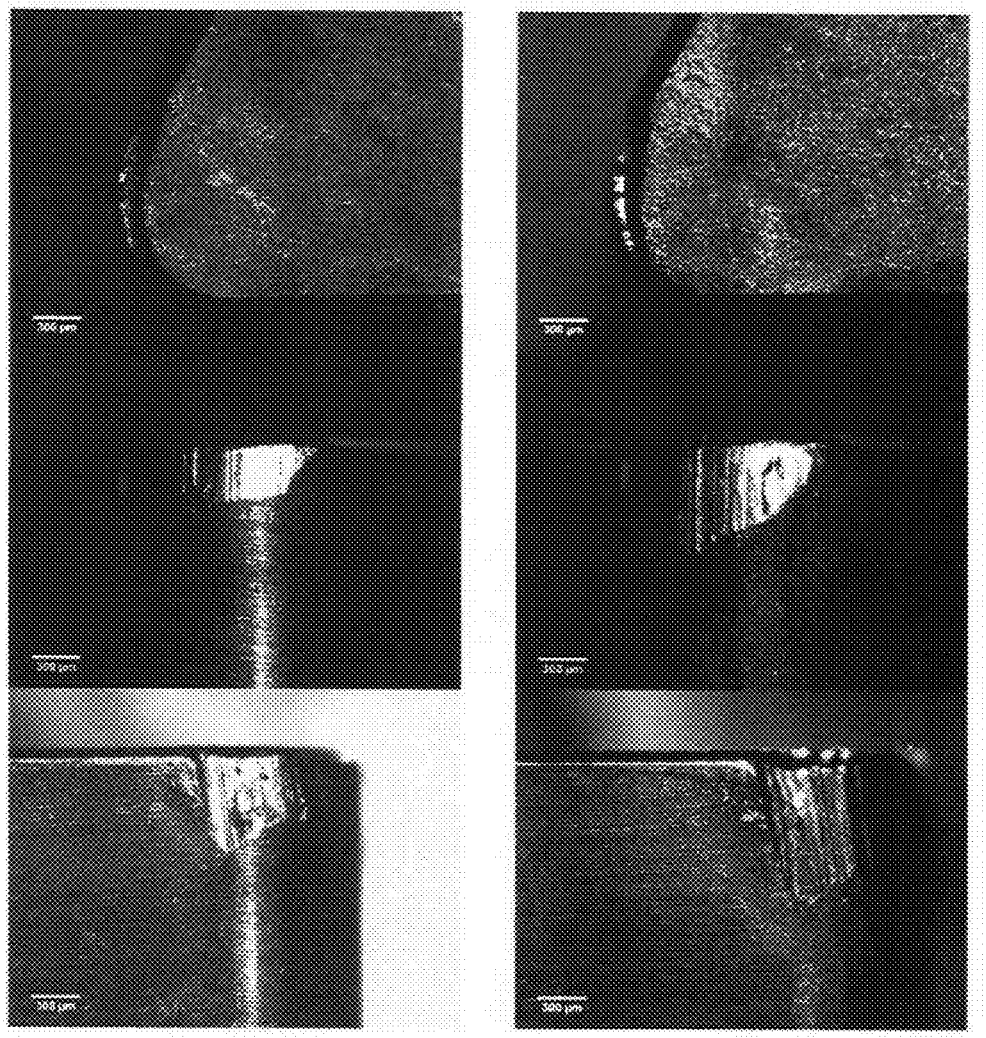
FIG. 7 is a series of photographs showing wear on cutting tools subjected to non-modulated cutting conditions.
Figure 8A:
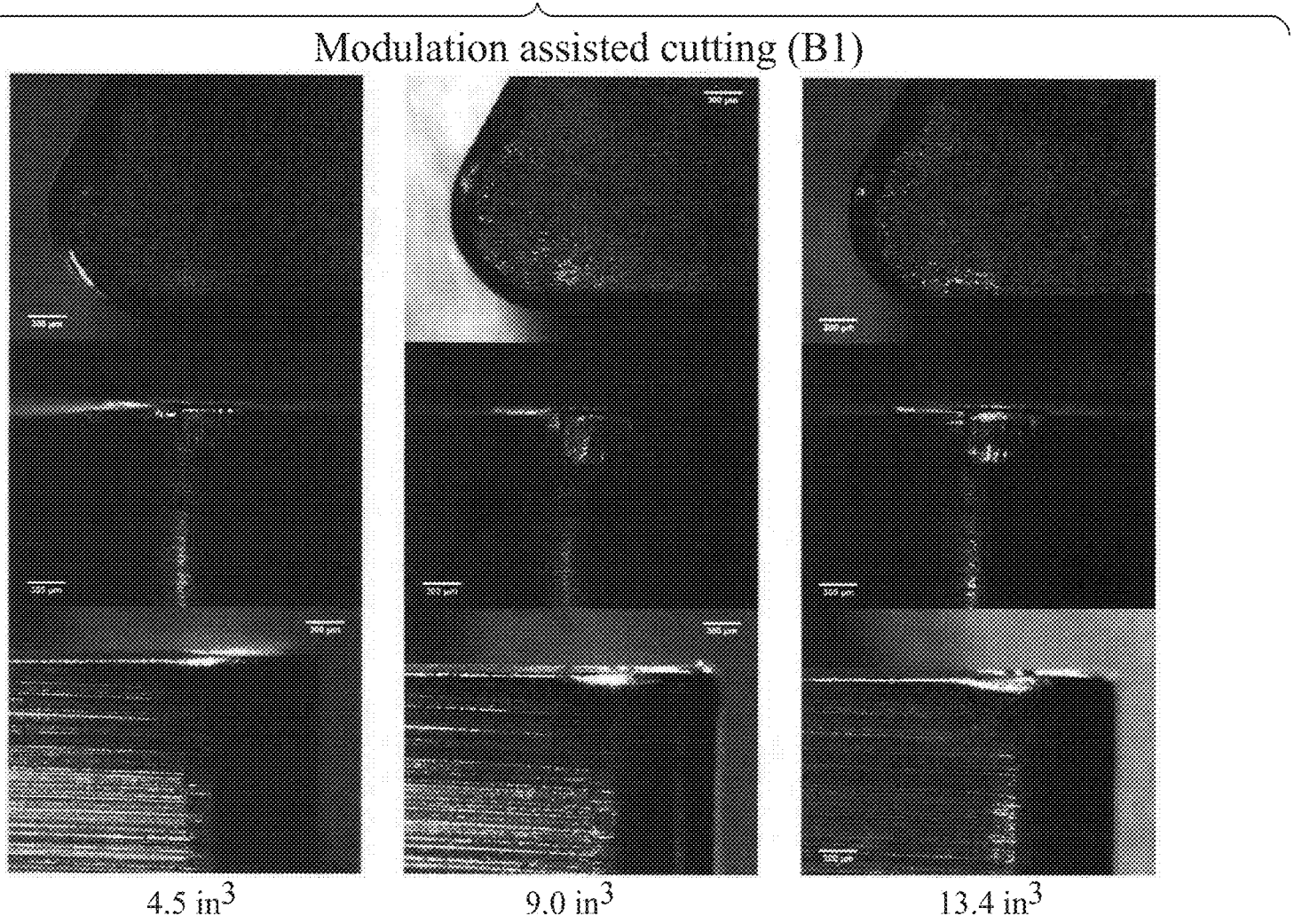
FIGS. 8A, 8B, and 8C are series of photographs showing wear on cutting tools subjected to modulation-assisted cutting conditions.
Figure 8B:
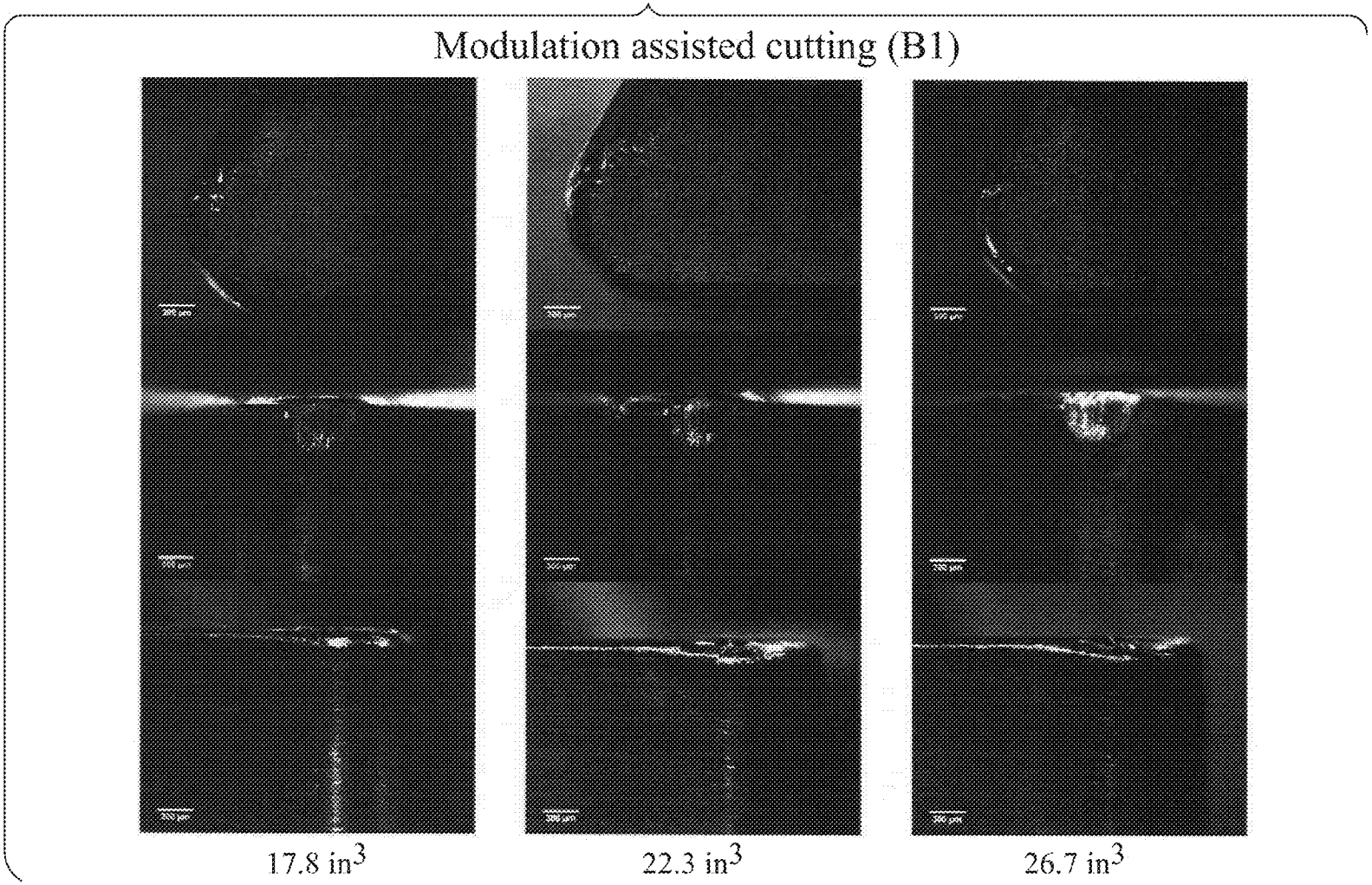
Figure 8C:
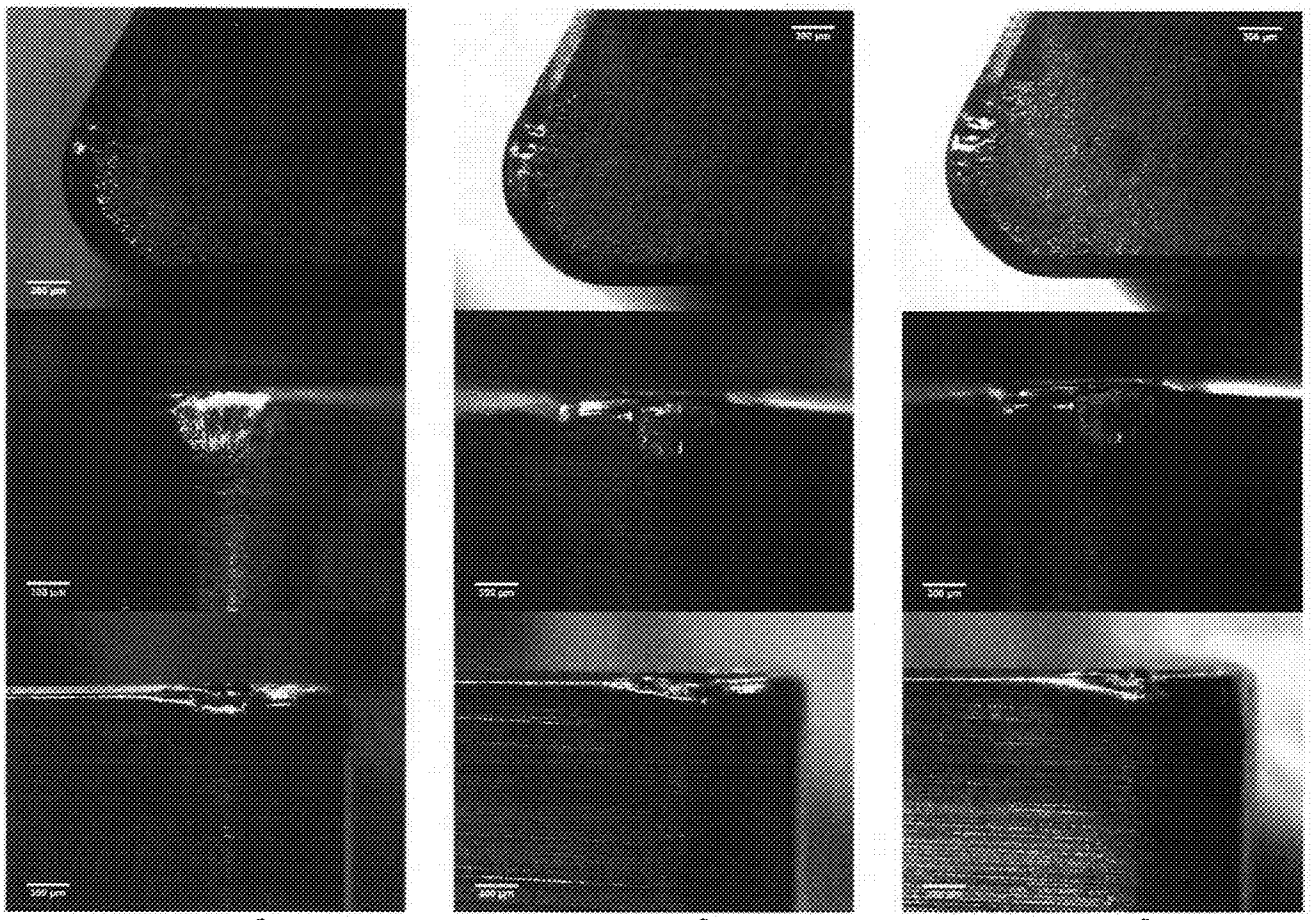

FIG. 7 shows the wear experienced by the non-modulated cutters in obtaining the data of FIG. 5, and FIGS. 8A, 8B, and 8C show the wear experienced by the modulation-assisted cutters, which is significantly less even at much larger cut volumes.

Figure 9A:
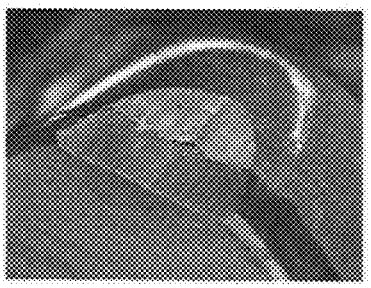
FIGS. 9A and 9B are photographs comparing PCD round cutter edges under simulated linear modulation and non-modulated conditions, respectively.
Figure 9B:
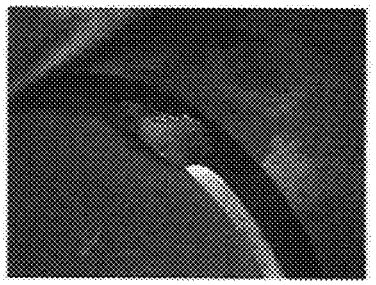

A simulation of a system using linear modulation without rotary motion was tested, and the results are shown in FIGS. 9A and 9B. In FIG. 9A, linear modulation was mimicked by putting grooves into the rock surface to interrupt drilling periodically (6 per revolution at 90 RPM, for example), breaking contact completely (using a gap of about 2 cm, for example) to allow edge cooling and lubrication by flood water.

In FIG. 9B, the same cutter type was used to cut the same rock without grooves, such that the edge was continually in contact with hard rock. The images of the cutting edge are from edges having cut the same amount (cubic inches) of rock, compensating for the grooves, and illustrate that the edge having experienced modulation has much less wear and essentially no chipping. While these benefits may be obtained using linear modulation only, by adding rotary modulation, the wear would be spread around the circumference of the cutter, and thus reduced even further.

While reference has been made to specific embodiments, it is apparent that other embodiments and variations can be devised by others skilled in the art without departing from their spirit and scope. The appended claims are intended to be construed to include all such embodiments and equivalent variations.

What is claimed is:

1. A method of prolonging life of a PDC cutter on a drill bit, the PDC cutter having a substantially cylindrical shape centered about a rotational axis, the method comprising:

imparting linear modulation to the PDC cutter relative to the drill bit in at least one direction;

imparting rotary modulation to the PDC cutter about the rotational axis; and synchronizing the rotary modulation with, and facilitated by, the linear modulation, wherein the rotary modulation is synchronized to occur when the cutter is linearly modulated away from a target surface; and wherein rotary motion is non-continuous and the PDC cutter moves when contact force decreases below an amount corresponding to an applied torque.

2. The method of claim 1, wherein a bearing enables rotational movement of the cutter about its axis; and wherein the rotary modulation is imparted by contact between cutting debris and the cutter when the cutter is fully disengaged from the target surface such that the bearing is substantially unloaded.

3. The method of claim 1, wherein the rotary modulation is imparted by a rotational actuator.

4. The method of claim 3, wherein the rotational actuator is a stepper motor.

5. The method of claim 3, wherein the rotational actuator is a hydraulic motor.

6. The method of claim 1, wherein the linear motion is imparted by a linear actuator.

7. The method of claim 6, wherein the linear actuator includes one or more piezoelectric elements.

8. The method of claim 1, wherein the linear modulation includes modulation in a direction tangential to a cutting direction.

9. The method of claim 1, wherein the linear modulation includes modulation in a direction normal to a cutting direction.

10. The method of claim 1, wherein the linear modulation is imparted at a frequency of at least about 1 Hz.

11. The method of claim 10, wherein the linear modulation is imparted at a frequency of less than or equal to about 10 kHz.

12. The method of claim 1, wherein the linear modulation is imparted at an amplitude of at least about 0.01 mm for every 1 m/s in cutting speed.

13. The method of claim 1, wherein the linear modulation is imparted at an amplitude of at least about 0.02 mm.

14. The method of claim 13, wherein the linear modulation is imparted at an amplitude of less than about 0.5 mm.

15. The method of claim 1, further comprising:

lubricating a cutting surface of the cutter with a fluid film that flows between the cutter and the target surface when the cutter is disengaged from the target surface due to one or both of the linear and rotary modulation.

16. An apparatus for multi-axis modulation of a PDC cutter on a drill bit, comprising:

means for modulating the PDC cutter relative to the drill bit relative to a target surface, normal to the target surface, or a combination thereof;

means for enabling free rotational modulation of the PDC cutter about a rotational axis when the cutter is at least partially disengaged from the target surface; and means for synchronizing the rotational modulation with, and facilitated by a linear modulation relative to the drilling bit, wherein the rotary modulation is synchronized to occur when the cutter is linearly modulated away from a target surface; and wherein rotary motion is non-continuous and the PDC cutter moves when contact force decreases below an amount corresponding to an applied torque.

17. The apparatus of claim 16, wherein the means for modulating the PDC cutter comprises a linear actuator.

18. The apparatus of claim 17, further comprising means for modulating the PDC cutter about the rotational axis.

19. The apparatus of claim 18, wherein means for modulating the PDC cutter about the rotational axis comprises a rotational actuator.

20. The apparatus of claim 19, wherein the rotational actuator and the linear actuator are synchronized to rotationally modulate the cutter only when the cutter is disengaged from the target surface.

21. The apparatus of claim 17, wherein the linear actuator includes at least one piezoelectric actuator.

22. The apparatus of claim 17, wherein the linear actuator impart linear modulation at a frequency of at least about 10 Hz and at an amplitude of at least about 0.2 mm.

23. The apparatus of claim 16, wherein the means for enabling free rotational modulation comprises a rotational bearing.

24. A method of prolonging the life of a PDC cutter on a drill bit, the PDC cutter having a substantially cylindrical shape centered about a rotational axis, the method comprising:

imparting linear modulation to the PDC cutter in at least one direction relative to the drilling bit; and lubricating a cutting surface of the PDC cutter with a fluid film that flows between the PDC cutter and the target surface when the cutter is fully disengaged from the target surface due to the linear modulation; and synchronizing a rotary modulation with, and facilitated by, the linear modulation, wherein the rotary modulation is synchronized to occur when the cutter is linearly modulated away from a target surface; and wherein rotary motion is non-continuous and the PDC cutter moves when contact force decreases below an amount corresponding to an applied torque.

* * * * *